US008196746B2

(12) United States Patent
Storandt

(10) Patent No.: US 8,196,746 B2
(45) Date of Patent: Jun. 12, 2012

(54) THREE PART HYGIENIC DISPENSING ASSEMBLY

(76) Inventor: Duane L. Storandt, St. Louis, MO (US)

( * ) Notice: Subject to any disclaimer, the term of this patent is extended or adjusted under 35 U.S.C. 154(b) by 841 days.

(21) Appl. No.: 11/738,242

(22) Filed: Apr. 20, 2007

(65) Prior Publication Data

US 2008/0257757 A1 Oct. 23, 2008

(51) Int. Cl.
*B65D 83/00* (2006.01)

(52) U.S. Cl. ..... 206/581; 206/369; 206/63.5

(58) Field of Classification Search ..... 206/581, 206/823, 449, 555, 484, 438, 63.5, 363, 368, 206/369
See application file for complete search history.

(56) References Cited

U.S. PATENT DOCUMENTS 3,368,668 A * 2/1968 Micciche ..... 206/229
3,608,566 A 9/1971 Storandt
3,675,264 A 7/1972 Storandt
3,902,509 A * 9/1975 Tundermann et al. ..... 433/142
4,105,120 A * 8/1978 Bradberry ..... 206/581
4,211,330 A * 7/1980 Strock ..... 206/581
4,739,809 A * 4/1988 Adams ..... 150/112
5,301,490 A 4/1994 Storandt
5,348,153 A * 9/1994 Cole ..... 206/361
5,356,397 A 10/1994 Storandt
5,454,207 A 10/1995 Storandt
5,487,201 A * 1/1996 Hansen et al. ..... 15/104.94
5,502,946 A 4/1996 Storandt
5,524,764 A * 6/1996 Kaufman et al. ..... 206/581
5,584,163 A 12/1996 Storandt
5,816,709 A * 10/1998 Demus ..... 383/61.2
5,833,061 A * 11/1998 Storandt ..... 206/292
2004/0200748 A1* 10/2004 Klassen et al. ..... 206/368
2006/0042992 A1* 3/2006 Vulcano ..... 206/581

* cited by examiner

*Primary Examiner* — Jacob K Ackun
(74) *Attorney, Agent, or Firm* — Ronald W. Hind

(57) ABSTRACT

This hygienic or aseptic multi-pouch package includes one or more inner pouches, finger, multi-finger and full hand sized capable of being carried by a card holder which is removably stored within an outer pouch. The inner pouch is suitable for use as a finger pouch which may be used to clean teeth or for similar purposes. When only one inner pouch is hygienically removed at a time, the remaining pouches can be conveniently resealed within the card holder in the outer pouch.

9 Claims, 3 Drawing Sheets

THREE PART HYGIENIC DISPENSING ASSEMBLY

CROSS-REFERENCE TO RELATED APPLICATIONS AND OTHER DOCUMENTS

Disclosure Document No. 603469 dated Jul. 10, 2006.

STATEMENT REGARDING FEDERALLY SPONSORED RESEARCH

Not Applicable.

BACKGROUND OF THE INVENTION

This invention relates generally to hygienic aseptic packaged pouches, individually, in a three part package assembly without contaminating pouches being removed or remaining. Hygienic dispensing of individual pouches is made possible by their structure, positioning inside an inner paper holder, and dispenser outer poly bag dispenser, printed directions for opening, pouch dispensing, removal and use, printed directions printed on the outside and inside paper holder.

In the prior art there are several examples of packages which though not limited to such use, are particularly suitable for providing a digital sheath impregnated with tooth powder. Such sheaths, for example, as shown in U.S. Pat. Nos. 5,401,290 and 5,454,207 have been successful but have not been provided with a readily available outer pouch for resealing.

SUMMARY OF THE INVENTION

This package assembly provides a solution to this problem by providing a three part system having 1) a plurality of individual inner digital pouches packaged within 2) a folded card holder contained within 3) an outer pouch, which is a tamper evident protective zip-lock poly bag or pouch.

The folded card holder provides a medium which permits instructions for hygienic use to be printed on the outside and inside of the card and which are clearly readable and refer to the top or shorter panel side up positioning and removal of pouches, i.e. "open this side for hygienic removal." The folded card may be provided with the sealable edges on two long sides, the sealable edges providing a third short side and the remaining side being open to afford access to the digital pouches held therewithin. The outer pouch includes a perforated portion disposed above the zip-lock which when removed, reveals the zip-lock and an opening affording access to the card holder when opened by un-zipping the outer pouch. The tear away portion of the outer pouch may include an aperture suitable for hanging a three part package for display purposes.

The finger pouch is hygienic or aseptic in that it is capable of being autoclaved or irradiated or the like as may be necessary. Also it may be necessary to provide peel seal adhesive around the inside of the card holder. The peel seals have the capability of being finger-pressure resealed to maintain the aseptic integrity of the enclosed inner pouches within the card holder.

The arrangement of the card holder within the tough (2 mil) poly bag or pouch is such that the folded over card is approximately the same width as the inside of the poly bag but the top of the card is substantially narrower than the zip-lock opening to render the card holder to be easily withdrawn up to a point where it is about two-thirds removed from the rectangular poly bag. At this limit the card holder can be removed so that even if the finger is not clear of the outer pouch, the hygienic integrity of the pouch is maintained even if the outer pouch is mislaid. Further, the card holder preferably has rounded corners to avoid being caught up on the poly bag.

The foregoing and other objects, features, and advantages of the invention, as well as presently preferred embodiments thereof, will become more apparent from the reading of the following description in connection with the accompanying drawings.

BRIEF DESCRIPTION OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
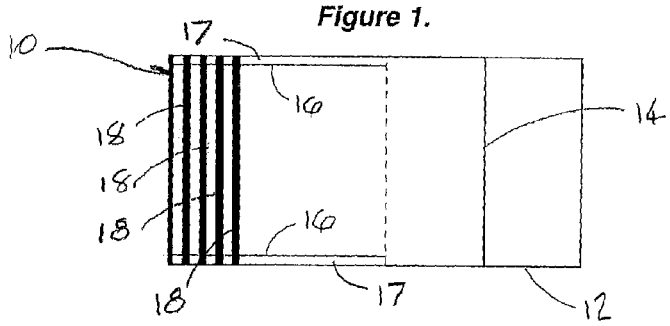
FIG. 1 is a plan view of an inner digital pouch.
Figure 2:
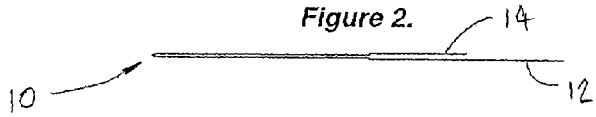
FIG. 2 is a side view of the pouch.

Referring now by reference characters to the drawings and first to FIGS. 1 and 2, there are shown a plan and side view of the inner pouch 10 prior to use. The pouch 10 has a long bottom panel 12 and a short upper panel 14 joined to the bottom panel 12 with which it is continuous and to which it is joined by narrow heat sealing lines 16 which are positioned away from side panel edges. These areas of unsupported fabric indicated by numeral 17 are very soft and even though they are in direct contact with delicate body tissues within the mouth will cause no discomfort. It will be understood that the stripes of the pre-medicated agents 18 can be alternately color coded to identify contents and applied to the upper panel before heat sealing into an outer pouch 10. Such pouches 10 range in size from single finger, multi-finger and full hand for cleaning, treating and medicating the delicate tissues within the mouth form the subject matter of prior art by the inventor herein, such as U.S. Pat. No. 5,401,490 and others.

Figure 3:
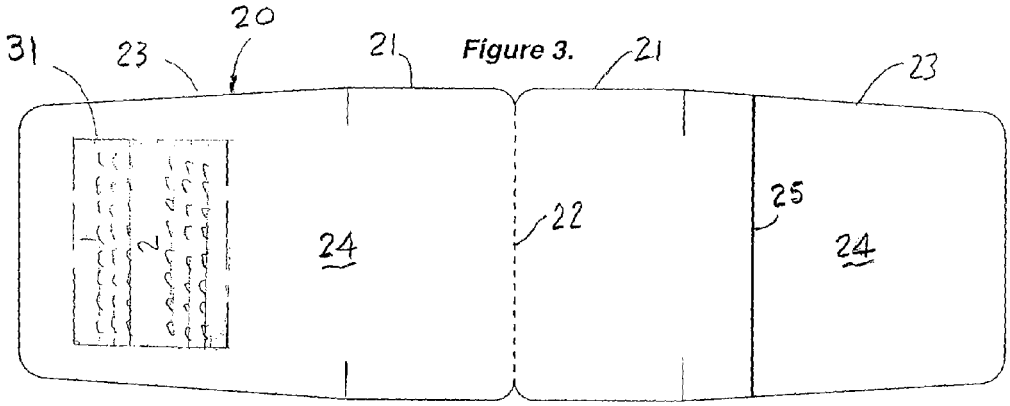
FIG. 3 is a plan view of the outside of the card holder prior to folding showing printed instructions for hygienic package opening and examination of contents.
Figure 4:
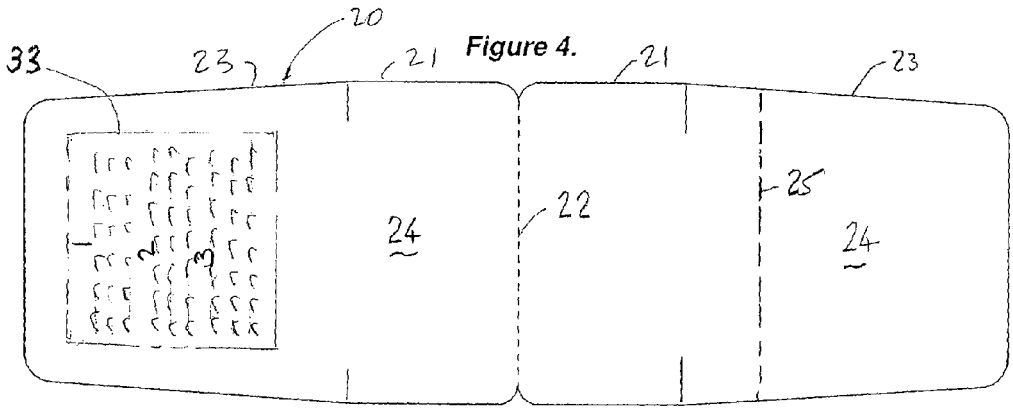
FIG. 4 is a plan view of the inside of the holder prior to folding showing printed instructions for individual hygienic pouch removal without compromising the remaining pouches.
Figure 5:
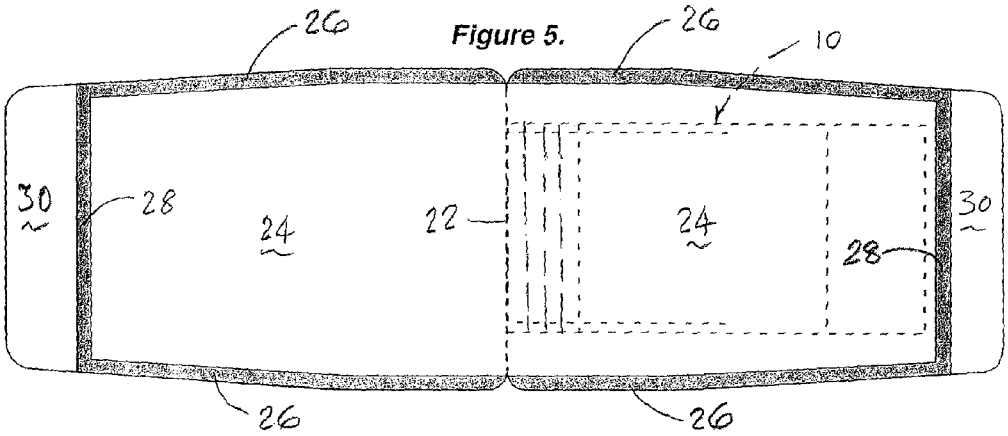
FIG. 5 is a plan view of the inside of the holder prior to folding showing the pouch in position inside the finger pressure resealable cold seal adhesive that encircles the inside of the holder.
Figure 6:
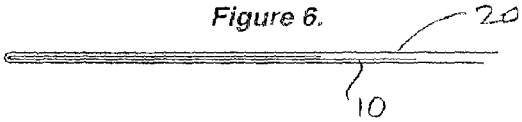
FIG. 6 is a side view of the folded holder with a pouch positioned inside.

FIGS. 3 and 4 show the tapered card holder which is enfolded about one or more pouches to provide a dispenser card holder 20 which commonly will include a number of inner pouches 10 placed on top of each other, for example a 12-pack. It will be observed (see FIG. 5) that the card holder 20 has a base fold line 22 which extends the card holder folded portions outwardly on both sides of the said fold line 22 so that when the two identically sized panels 24 are folded against each other, the two sides are preferably cold-sealed together to form a seal formed by two long sides 26 and two short sides 28 which co-operate to completely surround the inner pouch 10 therewithin. Lines 21 are straight and lines 23 are tapered. It will be understood that while the card shown in FIG. 5 is formed from a single folded card 24, it could be formed from two separate cards 24 joined at the baseline as by gluing. It will also be understood that although the term "card" is used, a plastic card or paper could also be used.

Figure 7:
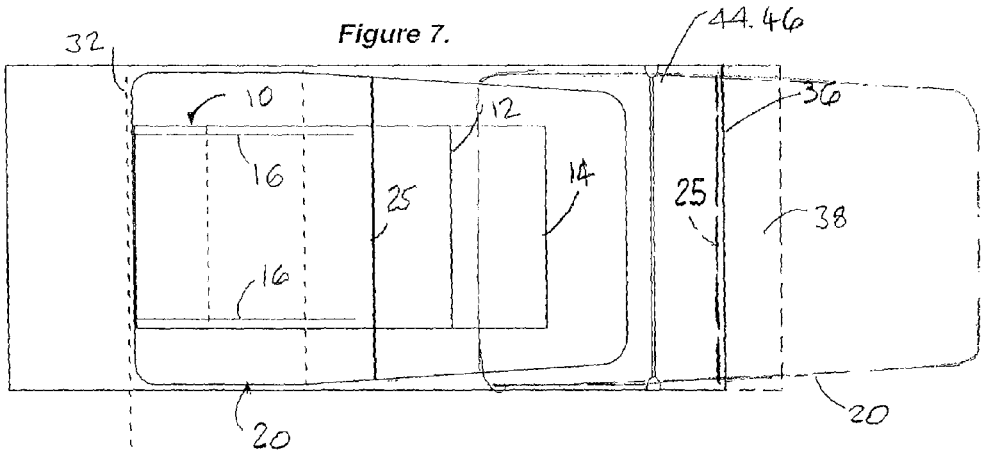
FIG. 7 is a plan view of the folded holder positioned within the outer pouch showing the dispenser card having a single inner pouch enclosed.

FIG. 7 shows the enfolded card holder 20 locked within a transparent outer pouch 40. To achieve this, the card holder 20 is fed into the outer pouch 40 with at least one inner pouch 10 arranged on the inside of the transparent outer pouch 40. When the card holder 20 is disposed on the inside of the outer pouch 40, extending beyond the line 32, the outer pouch 40 is heat sealed along line 32 and the end of the outer pouch 40 is torn off and discarded. At the other end, the zip-lock is closed and the tamper evident section of the bag 38 is torn off along the perforated line 36 after a purchase is made by a consumer. The broken outline is an indication of the card holder in the partially pulled out dispensing position.

Figure 8:
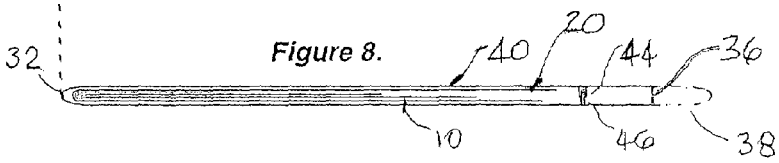
FIG. 8 is a side view of the dispenser package shown in FIG. 7 before tear-off of the tamper evident portion.
Figure 12:
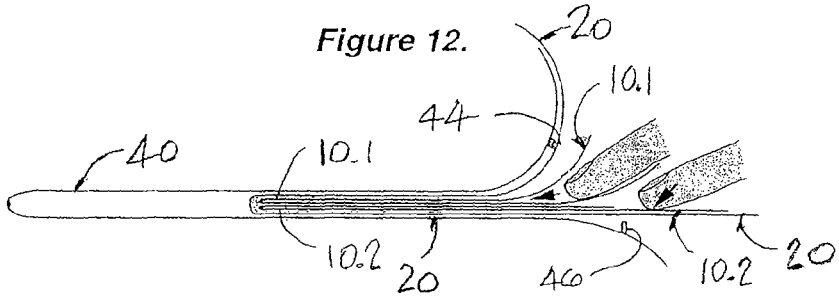
FIG. 12 is a similar view to FIG. 11 with the finger incipiently inserted in the top pouch and a finger holding the pouch below in position.
Figure 13:
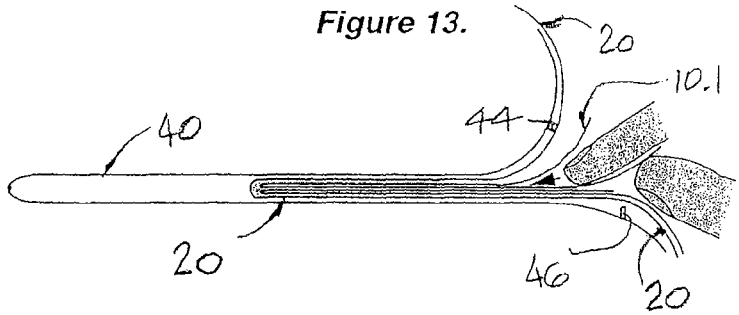
FIG. 13 is a final step prior to removal of the top pouch with a finger, and a digit, the thumb, holding the bottom panel of the pouch.
Figure 14:
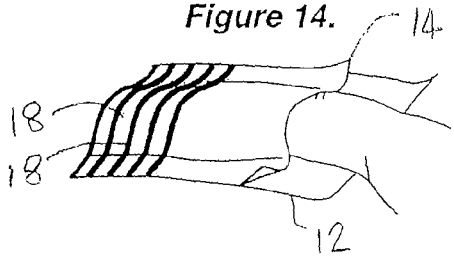
FIG. 14 is a view of a finger pouch removed and on the finger.

It will be assumed that a purchase has been made and the customer is in possession of an outer pouch 40 similar to that shown in FIGS. 7 and 8. The procedure to be followed to open the outer pouch 40 is best shown by FIGS. 8-14. It will be understood that FIGS. 12 and 13 illustrate two inner pouches 10.

It is thought that the component parts of the package have been fully understood from the foregoing description of parts, but for completeness of disclosure, the method of access to the inner finger pouch will be briefly described.

Figure 9:
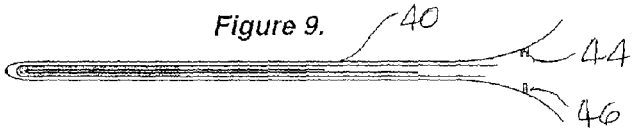
FIG. 9 is a similar view to that shown in FIG. 8 with the tamper-evident tear off section removed and the zip-lock open.
Figure 10:
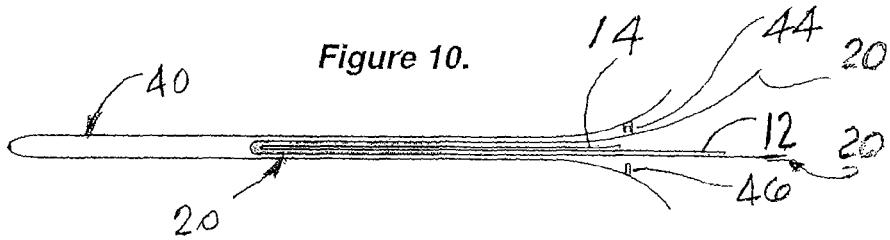
FIG. 10 is a side view of the outer pouch open and the card holder containing a single pouch partially removed.
Figure 11:
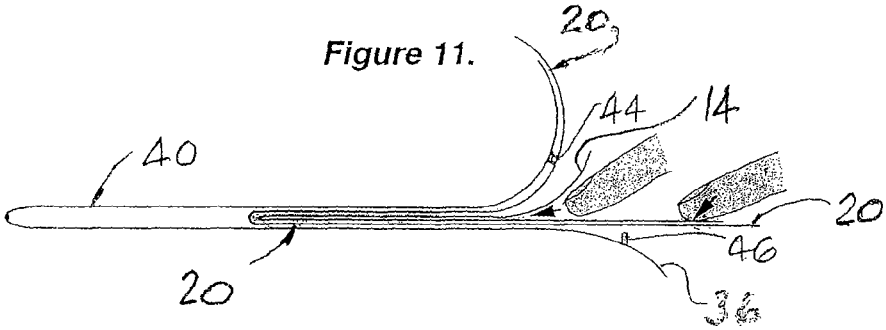
FIG. 11 is a similar view to FIG. 10 with a finger inserted into the single pouch and a finger holding the pouches bottom side panel in position.

First by reference to FIG. 8, the tamper evident tear off section 38 is removed, i.e. torn off. By "tamper evident" is meant that when the tear off section 38 is removed, before it reaches the end user, it is evident that the outer pouch 40 may have been tampered with. The outer pouch zip-lock 44 is then accessible and zipped into an open position as shown in FIG. 9. This access enables the joined top and bottom panels 24, of the card holder 20, to be accessible at the tab area opening 36, as shown for example in FIGS. 7 and 8 and the card holder 20 to be grasped by thumb and index finger and pulled partially out of the outer pouch 40 until the red line indicated by numeral 25 on the card holder 20 is approximately aligned with the tab area opening 36. This stage is shown in FIG. 10 and an index finger can then be inserted into the inner pouch 10 with the index finger or thumb of the other hand holding the long bottom pouch panel 12 in position. The inner pouch can then be removed easily by holding the panel 12 with the thumb as shown in FIG. 13. In this manner, the inner pouch 10 pulls out easily.

When only one inner pouch 10 is to be used, a simple set of instructions 31 may be used, for example:

1. To get finger in finger pouch, hold in place its long bottom side panel.
2. When you take out finger pouch, hold its bottom side panel with the thumb on the same hand.

As noted above, the system may be used with more than one inner pouch 10. FIGS. 12 and 13 illustrate this arrangement and the user is referred to the instructions printed on the inside of the inner card (see FIG. 4 at numeral 33) as follows:

1. Push the index finger of one hand inside the upper inner pouch 10.1.
2. Hold the index finger or the thumb of the other hand on the lower pouch 10.2 to hold it in place.
3. Remove the inner pouch 10.1 on the index finger held by the thumb on the same hand out of the card holder and the outer pouch 40.
4. Push the inner pouch 10.2 and the card holder 20 back into the outer pouch 40.
5. Seal the card holder 20 by means of the seal 26 all around the inner pouch 10.2.
6. Close the outer pouch 40 by means of the ziploc 44 to maintain the inner pouches in a hygienic condition.

Although the invention being described by making details reference to a preferred embodiment such detail is to be understood in an instructive rather than any restrictive sense, many variations being possible within the scope of the claims hereunto appended.

I claim as my invention:

1. In a three-part hygienic dispensing system, comprising:
a) one or more inner cleaning pouches;
b) a folded holder for containing and dispensing said one or more cleaning pouches;
c) an outer pouch sealed at one end for receiving the folded holder and cleaning pouches openable and closable at the other end for removing an inner pouch from the folded holder and replacing the folded holder and unused inner pouches in the outer pouch for future use; and
d) the one or more cleaning pouches being tooth-cleaning pouches formed from poly film and non-woven fabric material and the folded holder being tapered for easy entry into and exit from the outer pouch.

2. A dispensing system as defined in claim 1 wherein an inner pouch is digitally removable from the holder and the outer pouch is thereafter closed.

3. In a three-part hygienic dispensing system, comprising:
a) one or more inner cleaning pouches;
b) a folded holder for containing and dispensing said one or more cleaning pouches;
c) an outer pouch sealed at one end for receiving the folded holder and cleaning pouches openable and closable at the other end for removing an inner pouch from the folded holder and replacing the folded holder and unused inner pouches in the outer pouch for future use; and
d) said tapered holder has rounded corners to avoid catching on the inside of the outer pouch.

4. In a three-part hygienic dispensing system, comprising:
a) one or more inner cleaning pouches;
b) a separate, removable folded holder having opposed faces for containing and dispensing said one or more cleaning pouches therebetween;

c) an outer pouch sealed at one end for receiving the folded holder and cleaning pouches said outer pouch being openable and closable at the other end for removing an inner pouch from the folded holder and replacing the folded holder and unused inner pouches in the outer pouch for future use; and d) the outer pouch including means for the opening and closing of said outer pouch for access to said one inner pouch in said holder without tearing said outer pouch.

5. A dispensing system as defined in claim 4 wherein the portion of the outer pouch above the openable and closable means is removable to provide a tamper evident portion.

6. A dispensing system method of using inner pouches stored within a folded holder and having more than one inner pouches disposed one above the other and stored within an outer pouch having an openable and closable end comprising the following steps:

opening said one end of the openable pouch;

pushing an index finger of one hand inside an uppermost inner pouch in said outer pouch;

holding one of an index finger or thumb of the other hand on a bottom side panel of the outer pouch to hold it in place;

removing the inner pouch on the index finger out of the folded holder and out of the outer pouch;

holding the outer pouch below in position with a finger or thumb on the other hand as the inner pouch is removed and held by the thumb on the same hand holding its bottom side panel;

pushing the lower inner pouches remaining in the holder and the holder back into the outer pouch; and closing the outer pouch.

7. A dispensing system method as defined in claim 6 wherein a cold seal is disposed at least in part around the folded holder edges for maintaining the folded holder in a temporarily closed condition.

8. A dispensing system method as defined in claim 6 wherein printed instructions are provided on the folded dispensing holder within the outer pouch to explain the manner of use.

9. A dispensing system method as defined in claim 6 wherein the folded holder has a transverse line marked across it to designate a position to which the folded holder may be pulled out partly from the outer pouch until the line is approximately aligned with the end of the outer pouch to designate a position of the holder at which a finger may be inserted into an inner pouch to remove an inner pouch and returning the holder and remaining inner pouches to the outer pouch.

* * * * *